United States Patent [19]

Simon

[11] 4,149,723

[45] Apr. 17, 1979

[54] GAME APPARATUS INCLUDING A RESILIENT PROJECTILE WITH A PLURALITY OF LEGS

[75] Inventor: Abner J. Simon, Petersburg, Va.

[73] Assignee: Luther E. Russell, Sutherland, Va.

[21] Appl. No.: 798,101

[22] Filed: May 18, 1977

[51] Int. Cl.[2] ..... A63B 67/00; A63B 37/06; A63B 59/00

[52] U.S. Cl. ..... 273/95 R; 273/58 K; 273/67 R; 273/102 R; 273/106 R

[58] Field of Search ..... 273/95 R, 95 H, 102 R, 273/105 R, 106 R, 126 R, 127 R, 127 B, 128 R, 128 A, 129 R, 129 A, 67 R, 72 R, 58 K, 1 R, 1 B

[56] References Cited

U.S. PATENT DOCUMENTS

| | | | |
|---|---|---|---|
| 563,170 | 6/1896 | Haley et al. | 273/58 K |
| 2,002,631 | 5/1935 | Fiondella | 273/106 R |
| 2,099,521 | 11/1937 | Herkimer et al. | 273/72 R |
| 2,987,317 | 6/1961 | Acevedo | 273/67 R |
| 3,087,730 | 4/1963 | Buckner | 273/106 R X |
| 3,104,875 | 9/1963 | Doyle | 273/127 R X |
| 3,104,876 | 9/1963 | Salsinger | 273/127 R X |
| 3,214,168 | 10/1965 | Sauber | 273/67 R |
| 3,675,928 | 7/1972 | Gentile | 273/128 R |
| 3,851,880 | 12/1974 | Ritch | 273/128 R |
| 3,921,978 | 11/1975 | Warren | 273/67 R |

*Primary Examiner*—William H. Grieb

*Attorney, Agent, or Firm*—Schwartz, Jeffery, Schwaab, Mack, Blumenthal & Koch

[57] ABSTRACT

A game apparatus includes a projectile made of resilient foam material which is in the shape of an enlarged "jack" and a plurality of bats having soft impact areas which are used to strike the projectile so as to move the projectile between a pair of goal posts which are also preferably resilient. Generally, the game apparatus is used to play a game which resembles field hockey, but may be played indoors or in a relatively confined outdoor area. By utilizing relatively "soft" bats and a relatively soft projectile, the chance of injury is reduced. Since the projectile has the shape of a "jack" it will often follow an irregular trajectory and will not roll far after hitting the ground.

12 Claims, 6 Drawing Figures

Fig. 1.
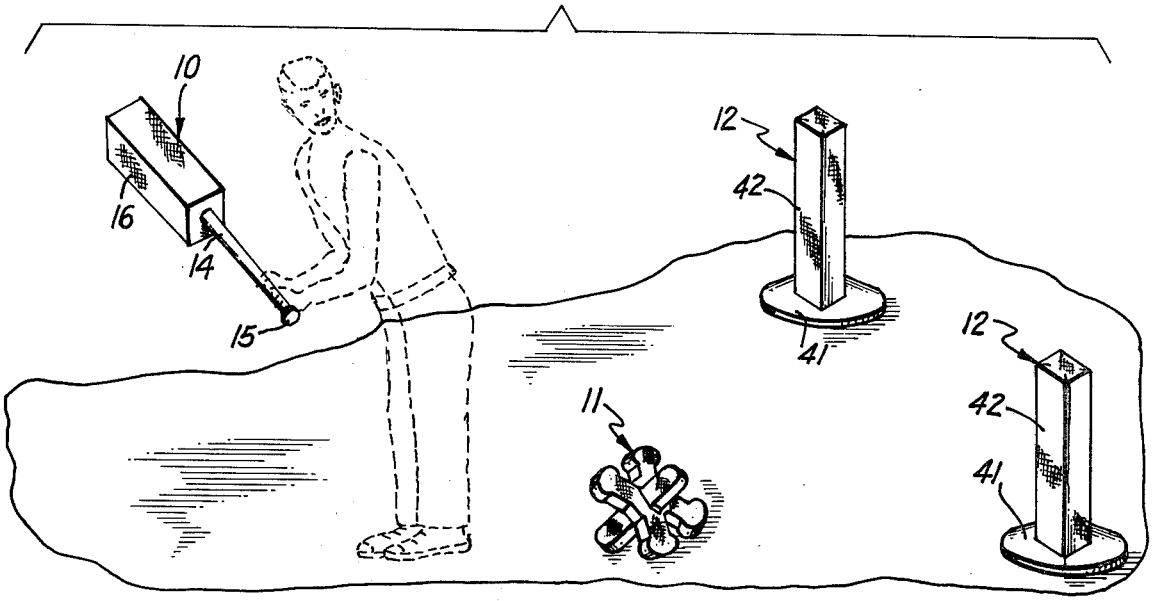
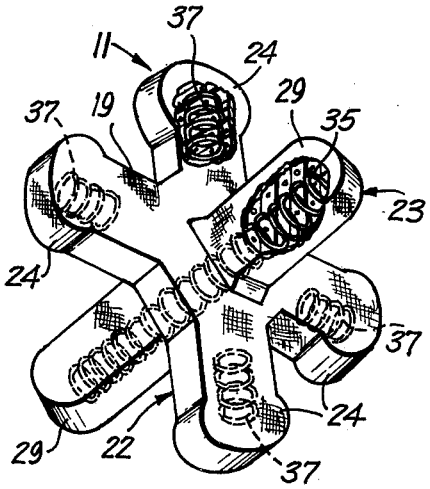
Fig. 2.
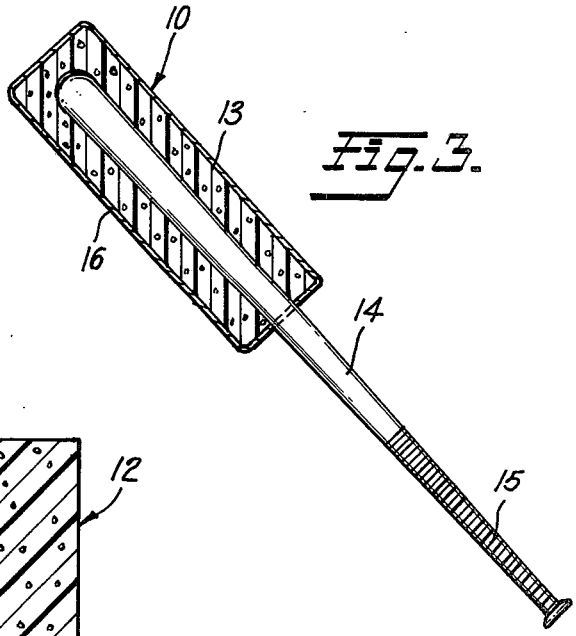
Fig. 3.
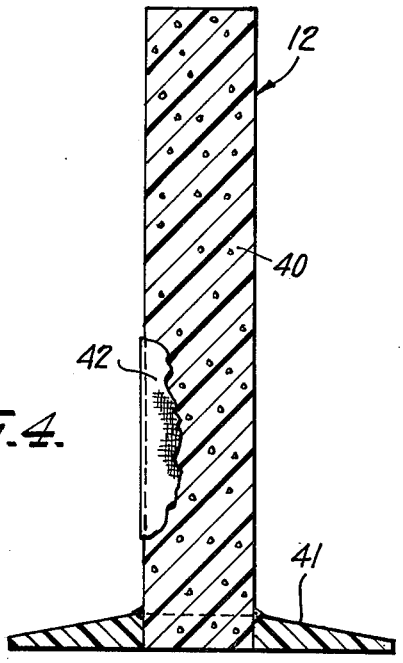
Fig. 4.

GAME APPARATUS INCLUDING A RESILIENT PROJECTILE WITH A PLURALITY OF LEGS

BACKGROUND OF THE INVENTION

1. Field of the Invention

The instant invention relates to game apparatus, and more particularly, the instant invention relates to game apparatus in which a projectile is knocked about by players with the object of eventually moving the projectile into or through a goal.

2. General Considerations and Prior Art

There are many games in which a bat or stick is utilized to strike or otherwise move a projectile about between players with the eventual object of scoring goals. These types of games provide humanity with much satisfaction and for centuries people have been playing games such as hockey, lacrosse, polo, and the like. Generally, such games require a lot of room, are expensive to organize and participate in, can be dangerous and cannot be played indoors without special provisions. The equipment used in these games is a primary source of injury since both the balls and sticks are hard and relatively rigid.

In view of the foregoing problems with games such as hockey, new games have been devised which retain the same organization and similar physical and emotional satisfaction for the players without subjecting the players to possible injury due to the nature of the equipment used. U.S. Pat. Nos. 3,675,928; 3,851,880 and 3,921,978 exemplify recent approaches to these types of games in which soft sticks, or bats and soft projectiles are utilized.

However, further development of the general type of games disclosed in these patents is desirable and necessary.

OBJECTS OF THE INVENTION

In view of the foregoing considerations, it is an object of this invention to provide a new and improved game apparatus wherein a relatively soft bat and relatively soft projectile are utilized.

It is a further object of this invention to provide a new and improved game apparatus wherein the enjoyment of goal type games using soft equipment is enhanced.

It is further object of the instant invention to provide a new and improved game apparatus in which a projectile has a novel shape which enables it to travel an irregular trajectory when it bounces.

It is still a further object of the instant invention to provide a new and improved game apparatus which is suitable for playing indoors or in a relatively confined outside area.

It is still another object of this invention to provide a new and improved game apparatus wherein a relatively soft projectile is primarily moved by striking it with relatively soft bats and wherein the projectile is relatively large and approximately the size of a basketball, volleyball, soccer ball, or the like.

THE SUMMARY OF THE INVENTION

With these and other objects in mind, the instant invention contemplates a game apparatus which is suitable for team sports. The apparatus includes a soft projectile having a plurality of legs projecting from a substantially central location and a plurality of bats for striking the projectile wherein each bat has a relatively soft impact portion. A pair of relatively soft goal posts are provided which include a flat relatively rigid base for supporting the posts.

The instant invention also contemplates a relatively soft projectile for a game apparatus wherein the projectile is in the form of a "jack" but is relatively large and approximates the diameter of a playing ball such as a basketball, soccer ball, volleyball or the like.

BRIEF DESCRIPTION OF THE DRAWINGS

FIG. 1 is a perspective view showing the various elements of the game and one player.

FIG. 2 is a perspective view, partially in section, of a projectile used in playing the game.

FIG. 3 is a side view, partially in section, of a bat used to play the game.

FIG. 4 is a side view in section of one of two goal posts used to form a goal used in the game.

DESCRIPTION OF THE PREFERRED EMBODIMENT

Figure 5:
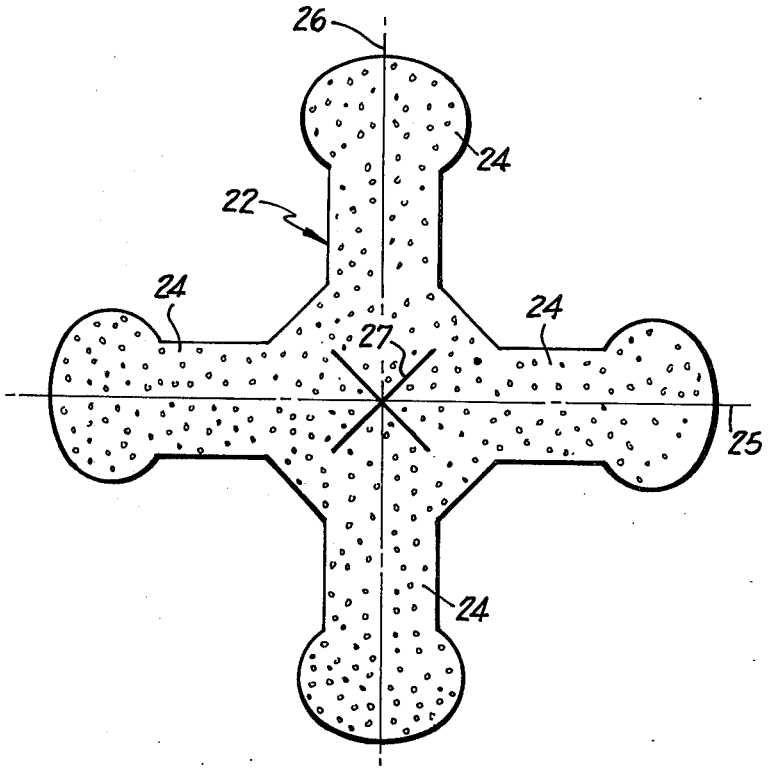
FIG. 5 is a top view of a first element of the projectile.

Referring now to FIG. 1 there is shown a single player utilizing the apparatus of the instant invention. The player is holding a bat, designated generally by the numeral 10, which is used to strike a projectile, designated generally by the numeral 11, that is configured in the shape of a "jack." In essence, the object of the game is to use the bat 10 to knock the projectile 11 between a pair of goal posts, designated generally by the numerals 12.

In playing a game utilizing the apparatus of the instant invention, preferably five players are on each team, although any convenient number can play. Each player is equipped with a bat 10 with which he endeavors to strike the projectile 11. As with a game such as hockey, two center players initiate the game by facing one another with the projectile 11 disposed between them. Each team is gathered on opposite sides of a center line (not shown) with their backs to their own goal formed by a pair of goal posts 12. Upon initiating play, the center players attempt to knock the projectile 11 to their own team with bats 10. Points are scored by striking an opposing team member with the projectile 11, or by knocking the projectile 11 between the goal posts 12.

In order to prevent injury to the players and to limit the expense for protective equipment necessary to play the game, each bat 10 is equipped with a soft resilient impact portion 13, made of foam rubber or the like, which deforms upon striking an object and then returns to its original shape. As is seen in FIG. 3, the impact portion 13 is mounted on a tapered elongated member 14 which is preferably in the form of a conventional plastic baseball bat. The member 14 has a handle portion 15 which is wrapped with tape or the like and is preferably hollow so as to be relatively light in weight. In order to mount the impact portion 13 on the elongated member 14, an "X-shaped" slit is made through the center of the impact portion 13 and the elongated member 14 is simply slid into the impact portion 13. The impact portion 13 is then covered with a fabric covering 16 of denim, canvas, dacron or the like which extends past the impact portion and is secured to the elongated member 14.

Figure 6:
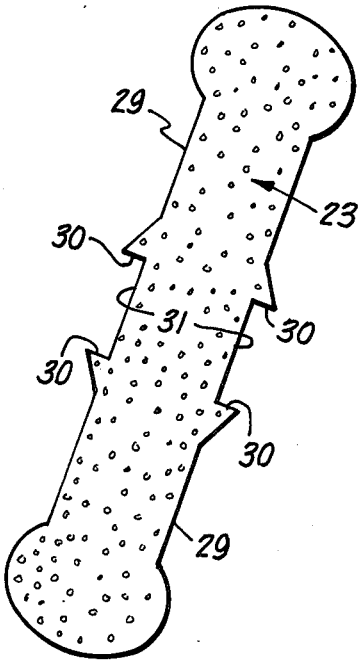
FIG. 6 is a side view of a second element of the projectile which fits through the first element to form the completed projectile.

Referring now to FIGS. 2, 5 and 6, the projectile 11 is readily seen as having the shape of a "jack" similar to the piece which is used in playing the childs game of "pickup jacks" but being obviously much larger. In order to prevent players from being injured upon being struck by the projectile 11, the projectile 11 is also made from a resilient or soft material such as foam rubber or the like. In order to protect the foam rubber, a projectile 11 is covered with a fabric 19 made from a material such as denim, canvas, dacron or the like. Preferably, the projectile has a diameter of about 12 inches and approximately the size of a soccer ball, volleyball, basketball or the like.

As is seen in FIGS. 5 and 6, the projectile 11 is preferably made from first and second pieces 22 and 23, respectively. The first piece 22 includes four legs 24 each disposed 90° from one another and projecting in the same plane. The legs have enlarged ends which gives the projectile 11 the appearance of a "jack". The two axes of the legs 25 and 26 intersect at a center point at which an "X-shaped" slit 27 is made through the foam material. The second piece 23 is inserted through the "X-shaped" slit 27 so as to project normal to the plane containing the legs 24 of the first piece. Each leg 29 of the second piece 23 projects from an opposite side of the first piece 22. In order to hold the second piece 23 in place, shoulders 30 are formed adjacent the center of the second piece and define a groove 31 having a width substantially equal to the thickness of the first piece 22. In this way, a projectile 11 having the shape of a "jack" such as shown in FIG. 2 is formed wherein the fixed legs 24 and 29 are arranged along three, mutually orthogonal axes which intersect at a common point.

Referring now further to FIG. 2, the projectile 11 may also include the springs 35 and 37 imbedded in the legs 29 and 24 respectively. Preferably, the springs 35 and 37 are coil springs. As is seen in FIG. 2, the spring 35 is a single spring which extends substantially entirely along the length of the second member 23. The springs 37 do not extend completely along an axis because they would interfere with one another and with the spring 35 during assembly of the projectile 11. By using the springs 35 and 37, the projectile 11 is made more lively.

It is readily seen that the projectile 11 will not roll as readily as a ball and will come to rest more quickly making it a more suitable device for indoor play or play in a limited area than a round object. In addition, the legs 24 and 29 will cause the projectile 11 to frequently assume an irregular path as it moves along the ground or floor. This irregular motion is enhanced by the use of the springs 35 and 37.

Referring now to FIG. 4, where a single goal posts 21 is shown, it is seen that each goal post includes a vertically extending post portion 40 which projects from a horizontally extending base 41. As with the bat 10 and projectile 11, the post portion 40 is made from a resilient material such as foam rubber and is covered with a fabric material 42 such as denim, canvas, dacron or the like. The base 41 may be made of wood, plastic or any suitable material and extends horizontally a sufficient amount to keep the goal post 12 from toppling.

The foregoing detailed description is to be clearly understood as given by way of illustration and example only, the spirit and scope of this invention being limited solely by the appended claims.

I claim:

1. A game apparatus suitable for team sports comprising:

(a) a projectile having six legs arranged along three mutually orthogonal axes which intersect at a common point where in four of the legs of the projectile lie in the same plane and are made of a first element of soft resilient foam that includes a central slit where the axes of the legs intersect while the remaining two legs, projecting normal to said plane, are made of a second element of resilient foam which is inserted through the central opening of the first element; wherein a spring extends within each leg of the projectile to increase the liveliness thereof, and wherein the projectile is covered with fabric;

(b) a plurality of bats for striking the projectile wherein each bat has a handle portion which is relatively rigid and an impact portion which is soft and resilient, and (c) at least one pair of goal posts whereby an object of the game is to move the projectile between the pair of posts.

2. The game apparatus of claim 1 wherein the soft, resilient material of the impact portion of each bat is made of a resilient foam and wherein the resilient foam is covered with a fabric.

3. The game apparatus of claim 1 wherein the legs of the projectile extend approximately 6 inches so that the total diameter of the projectile is approximately 12 inches.

4. The game apparatus of claim 1 wherein the bat includes a relatively rigid elongated member which tapers into the handle portion toward one end and is surrounded by resilient foam material at the other end to form the impact portion.

5. The game apparatus of claim 1 wherein each post of at least one pair of said goal posts comprises soft, resilient material and includes a flat, relatively rigid base for supporting the post.

6. A game apparatus suitable for team sports comprising:

(a) a free projectile having a plurality of relatively soft, resilient, intersecting legs, said legs of the projectile extending in at least two intersecting planes so as to define a three dimensional projectile wherein springs extend in at least one leg associated with each of said at least two intersecting planes, at least one of said springs being a coil spring;

(b) a plurality of bats for striking the projectile wherein each bat has a handle portion which is relatively rigid and an impact portion which is soft and resilient; and (c) at least one pair of goal posts whereby an object of the game is to move the projectile between the pair of posts.

7. A projectile used in playing a game comprising six legs arranged along three mutually orthogonal axes which intersect at a common point wherein four of the legs of the projectile lie in the same plane and are made of a first element of soft resilient foam that includes a central slit where the axes of the legs intersect while the remaining two legs, projecting normal to said plane, are made of a second element of resilient foam which is inserted through the central opening of the first element; wherein a spring extends within each leg of the projectile to increase the liveliness thereof, and wherein the projectile is covered with fabric.

8. The projectile of claim 7 wherein the legs of the projectile extend approximately 6 inches so that the total diameter of the projectile is approximately 12 inches.

9. The projectile of claim 7 wherein the second element has a spring extending substantially along the length thereof and wherein the first element has separate spring means in each leg.

10. The projectile of claim 9 wherein the second element has spaced shoulders thereon which abut the first element on opposite sides thereof adjacent the slit to retain the second element within the slit of the first element.

11. The projectile of claim 10 wherein the springs are coil springs.

12. The projectile of claim 10 wherein at least some of the legs have enlarged rounded ends.

* * * * *